US011293232B2

(12) United States Patent
Dunbar

(10) Patent No.: US 11,293,232 B2
(45) Date of Patent: Apr. 5, 2022

(54) DRILL BIT WITH ADJUSTABLE INNER GAUGE CONFIGURATION

(71) Applicant: Halliburton Energy Services, Inc., Houston, TX (US)

(72) Inventor: Bradley David Dunbar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 24 days.

(21) Appl. No.: 16/627,877

(22) PCT Filed: Aug. 17, 2017

(86) PCT No.: PCT/US2017/047452

§ 371 (c)(1),
(2) Date: Dec. 31, 2019

(87) PCT Pub. No.: WO2019/035838

PCT Pub. Date: Feb. 21, 2019

(65) Prior Publication Data

US 2020/0165876 A1 May 28, 2020

(51) Int. Cl.

| | |
|---|---|
| ***E21B 10/14*** | (2006.01) |
| ***E21B 7/06*** | (2006.01) |
| ***E21B 10/20*** | (2006.01) |
| ***E21B 10/42*** | (2006.01) |
| ***E21B 10/62*** | (2006.01) |

(52) U.S. Cl.

CPC ..... *E21B 10/14* (2013.01); *E21B 7/064* (2013.01); *E21B 10/20* (2013.01); *E21B 10/42* (2013.01); *E21B 10/62* (2013.01)

(58) Field of Classification Search

CPC ..... E21B 10/04; E21B 7/064; E21B 10/14; E21B 10/26; E21B 10/28; E21B 10/40; E21B 10/42; E21B 10/43; E21B 10/62; E21B 10/64

See application file for complete search history.

(56) References Cited

U.S. PATENT DOCUMENTS 1,820,379 A * 8/1931 Dallerup ..... E21B 10/10 175/364
1,836,638 A * 12/1931 Wright ..... E21B 10/04 175/333

(Continued)

FOREIGN PATENT DOCUMENTS

WO WO-2017014730 A1 * 1/2017 ..... E21B 10/43

OTHER PUBLICATIONS

ISRWO International Search Report and Written Opinion for PCT/US2017/047452 dated Feb. 27, 2018.

*Primary Examiner* — Blake Michener
(74) *Attorney, Agent, or Firm* — Thomas Rooney; C. Tumey Law Group PLLC

(57) ABSTRACT

A drill bit can include a bit body having an upper portion, a central bore, and an adjustable inner gauge. The central bore can define a bore surface, and the bit body can include a plurality of fixed cutters formed on the upper portion. The adjustable inner gauge may be movably positioned within the bit body central bore to increase or decrease an exposed area of the bore surface for adjusting stability or steerability of the drill bit while forming the wellbore.

19 Claims, 6 Drawing Sheets

(56) References Cited

U.S. PATENT DOCUMENTS 2,054,255 A * 9/1936 Howard ..... E21B 10/04 175/298
2,975,849 A * 3/1961 Stuart ..... E21B 10/04 175/333
3,055,443 A * 9/1962 Edwards ..... E21B 10/04 175/405.1
3,250,337 A * 5/1966 Demo ..... E21B 10/04 175/343
3,306,377 A * 2/1967 Johnson ..... E21B 10/66 175/261
3,765,493 A * 10/1973 Rosar ..... E21B 4/006 175/319
5,016,718 A * 5/1991 Tandberg ..... E21B 10/04 175/333
5,176,212 A * 1/1993 Tandberg ..... E21B 10/04 175/333
5,361,859 A 11/1994 Tibbitts
5,472,057 A * 12/1995 Winfree ..... E21B 4/02 175/101
5,497,841 A * 3/1996 Cox ..... B28D 1/041 175/213
5,845,722 A * 12/1998 Makohl ..... E21B 7/208 175/101
7,258,179 B2 * 8/2007 Hall ..... E21B 10/62 175/404
7,506,701 B2 * 3/2009 Hall ..... E21B 7/064 175/399
7,520,343 B2 * 4/2009 Hughes ..... E21B 10/64 175/171
8,201,642 B2 * 6/2012 Radford ..... E21B 10/26 175/262
8,550,190 B2 * 10/2013 Hall ..... E21B 10/26 175/385
8,839,886 B2 9/2014 Jones et al.
9,181,756 B2 * 11/2015 Schwefe ..... E21B 10/62
10,233,695 B2 * 3/2019 Guan ..... E21B 10/62
10,648,238 B2 * 5/2020 von Gynz-Rekowski ..... E21B 10/46
10,711,527 B2 * 7/2020 Lange ..... E21B 10/62
10,876,360 B2 * 12/2020 Grosz ..... E21B 10/14
10,995,557 B2 * 5/2021 Grosz ..... E21B 10/14
2006/0180354 A1 * 8/2006 Belnap ..... E21B 10/573 175/374
2007/0181340 A1 8/2007 Eddison
2007/0221408 A1 * 9/2007 Hall ..... E21B 6/00 175/57
2010/0181112 A1 7/2010 Radford et al.
2010/0181115 A1 7/2010 Eddison
2013/0228382 A1 * 9/2013 Sauvageau ..... E21B 10/60 175/331
2014/0174827 A1 6/2014 Schen et al.
2016/0097237 A1 4/2016 Spencer et al.

* cited by examiner

DRILL BIT WITH ADJUSTABLE INNER GAUGE CONFIGURATION

TECHNICAL FIELD

The present disclosure generally relates to downhole tools, and more specifically, to drill bits including positionally adjustable gauge pads.

BACKGROUND

Often in operations for the exploration, drilling and production of hydrocarbons, water, geothermal energy or other subterranean resources, a rotary drill bit is used to form a wellbore through a geologic formation. Rotary drill bits may generally be classified as either fixed-cutter drill bits with stationary cutting elements, or roller-cone drill bits with cutting elements mounted on one or more roller cones that are mounted for rotation with respect to a bit body of the drill bit.

Fixed-cutter drill bits are often referred to as "drag bits" and may be constructed with a plurality of fixed cutting elements mounted to the bit body. The bit body for a fixed-cutter drill bit may be constructed of a metallic material such as steel or a matrix material formed by infiltrating a reinforcement material with a molten binder. The fixed cutting elements can be affixed to an outer profile of the bit body such that hard surfaces on the cutting elements are exposed to the geologic formation when forming a wellbore. The cutting elements generally operate to remove material from the geologic formation, typically by shearing formation materials as the drill bit rotates within the wellbore.

Roller-cone drill bits may be constructed of one or more roller cones rotatably mounted to the bit body, wherein cutting elements are disposed on the roller cones. The roller cones roll along the bottom of a wellbore as the roller-cone drill bit is rotated. The cutting elements on the roller cones generally operate to remove material form the geologic material from the geologic formation, typically by crushing, gouging and/or scraping material from the geologic formation to drill the wellbore. Hybrid drill bits have been developed with features of both fixed-cutter and roller cone drill bits for various purposes. For example, in some instances, a hybrid drill bit may be more durable, thereby permitting greater depths to be drilled before requiring maintenance or replacement of the drill bit than either a fixed-cutter drill bit or roller-cone drill bit alone.

Conventional drill bits use a gauge pad, generally coupled to an outer surface of the rotary drill bit with various elements to maintain stability or to increase steerability based on the gauge pad contact with the outer diameter of the hole being drilled. The aforementioned configuration makes it difficult to adjust gauge pad contact with the outer diameter of the hole being drilled.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
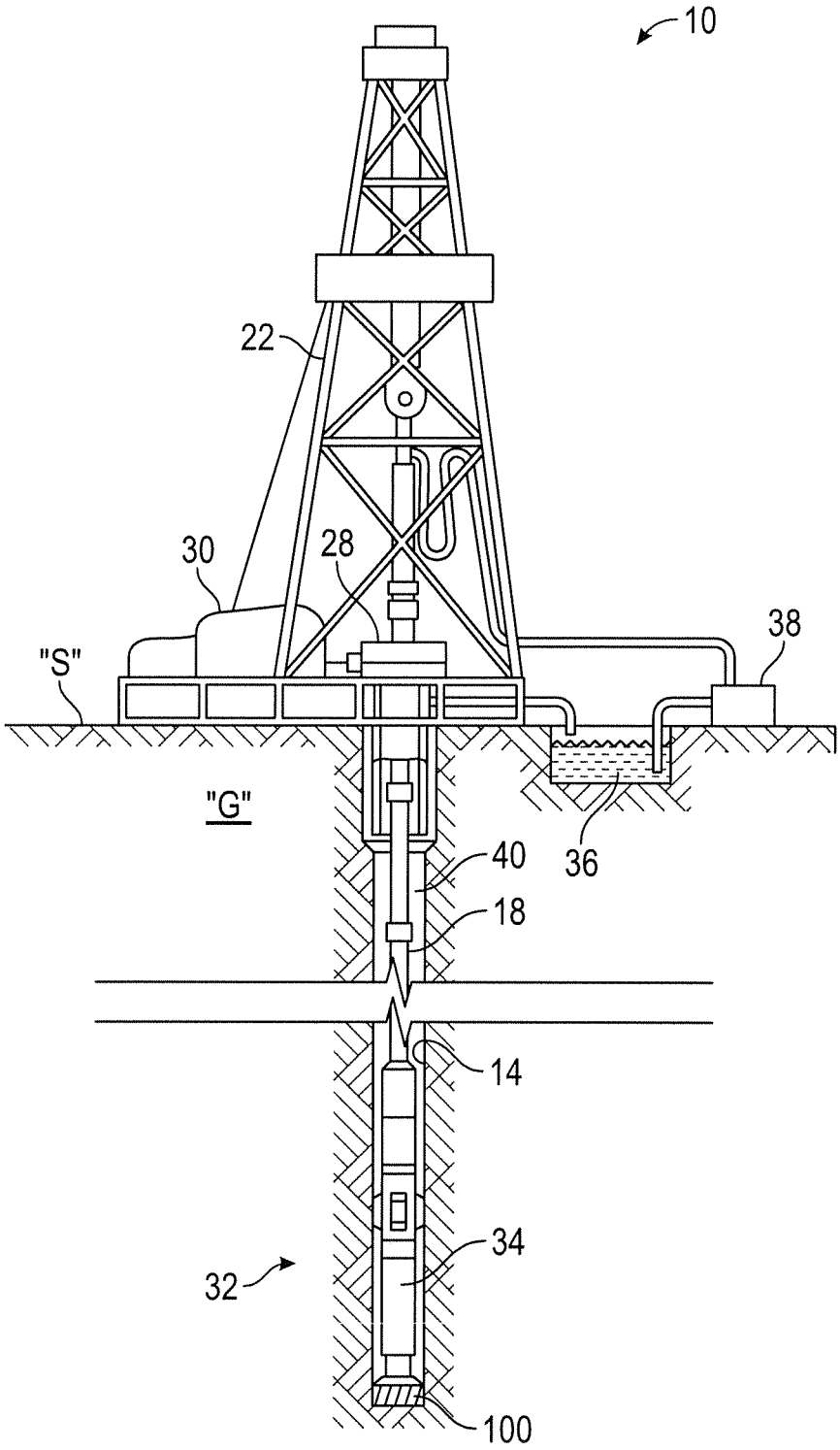
FIG. 1 illustrates a drilling system incorporating an exemplary drill bit.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, up-hole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the up-hole direction being toward the surface of the wellbore, the downhole direction being toward the toe of the wellbore.

Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a figure may depict an apparatus in a portion of a wellbore having a specific orientation, unless indicated otherwise, it should be understood by those skilled in the art that the apparatus according to the present disclosure may be equally well suited for use in wellbore portions having other orientations including vertical, slanted, horizontal, curved, etc. Likewise, unless otherwise noted, even though a figure may depict an onshore or terrestrial operation, it should be understood by those skilled in the art that the apparatus according to the present disclosure is equally well suited for use in offshore operations. Further, unless otherwise noted, even though a figure may depict a wellbore that is partially cased, it should be understood by those skilled in the art that the apparatus according to the present disclosure may be equally well suited for use in fully open-hole wellbores.

The present disclosure includes hybrid drill bits including drill bits including positionally adjustable inner gauge pads (adjustable inner gauge). In some embodiments, the adjustable inner gauge is reciprocably disposed in the inner bore of the drill bit. This configuration yields the advantage that the adjustable inner gauge may be axially moved as a single piece within the bore as desired to yield improved steerability or stability. This is in contrast to conventional drill bits where the gauge element is traditionally mounted on an outer surface of the drill bit body. The area in which the gauge elements in conventional drill bits may be axially moved is limited due to a dedicated area of the drill bit being necessary for positioning of the junk slots.

Accordingly, then, the present disclosure is related to wellbore drilling and, more specifically, to directional control of a rotary steerable drilling assembly. A directional drilling technique can involve the use of a rotary steerable drilling system that controls an azimuthal direction and/or degree of deflection while the entire drill string is rotated continuously. Rotary steerable drilling systems typically involve the use of an actuation mechanism that helps the drill bit deviate from the current path using either a "point the bit" or "push the bit" mechanism. In a "point the bit" system, the actuation mechanism deflects and orients the drill bit to a desired position by bending the drill bit drive shaft within the body of the rotary steerable assembly. As a result, the drill bit tilts and deviates with respect to the wellbore axis. In a "push the bit" system, the actuation mechanism is used to instead push the drill string against the wall of the wellbore, thereby offsetting the drill bit with respect to the wellbore axis. While drilling a straight section, the actuation mechanism remains disengaged so that there is generally no pushing against the formation. As a result, the drill string proceeds generally concentric to the wellbore axis. Yet another directional drilling technique, generally referred to as the "push to point," encompasses a combination of the "point the bit" and "push the bit" methods. Rotary steerable systems may utilize a plurality of steering pads that can be actuated in a lateral direction to control the direction of drilling, and the steering pads may be controlled by a variety of valves and control systems.

FIG. 1 illustrates a drilling system 10 incorporating an exemplary hybrid drill bit 100. In some embodiments, drilling system 10 is partially disposed within a wellbore 14 extending from a surface location "S" and traversing a geologic formation "G." In the illustrated example, the wellbore 14 is shown generally vertical, though it will be understood that the wellbore 14 may include any of a wide variety of vertical, directional, deviated, slanted and/or horizontal portions therein, and may extend along any trajectory through the geologic formation "G."

The hybrid drill bit 100 is provided at a lower end of a drill string 18 for cutting into 10 the geologic formation "G." When rotated, the hybrid drill bit 100 operates to break up and generally disintegrate the geological formation "G." The hybrid drill bit 100 may be rotated in any of a variety of ways. In this example, at the surface location "S" a drilling rig 22 includes a turntable 28 that may be operated to rotate the entire drill string 18 and the hybrid drill bit 100 coupled to the lower end of the drill string 18. The turntable 28 is selectively driven by an engine 30, chain-drive system, or other apparatus.

In some embodiments, a bottom hole assembly (BHA) 32 provided in the drill string 18 may include a downhole motor 34 to selectively rotate the hybrid drill bit 100 with respect to the rest of the drill string 18. The motor 34 may generate torque in response to the circulation of a drilling fluid, such as mud 36, therethrough. As those skilled in the art will recognize, the ability to selectively rotate the hybrid drill bit 100 relative to the drill string 18 may be useful in directional drilling, and/or for other operations as well. The mud 36 may be pumped downhole by mud pump 38 through an interior of the drill string 18. Thus, the mud 36 passes through the downhole motor 34 of the BHA 32 where energy is extracted from the mud 36 to turn the hybrid drill bit 100. As the mud 36 passes through the BHA 32, the mud 36 may lubricate bearings (not explicitly shown) defined therein before being expelled through nozzles 124 (FIG. 2) defined in the hybrid drill bit 100. The mud 36 works to flush geologic cuttings and/or other debris from the path of the hybrid drill bit 100 as it continues to circulate back up through an annulus 40 defined between the drill string 18 and the geologic formation "G." The geologic cuttings and other debris are carried by the mud 36 to the surface location "S" where the cuttings and debris can be removed from the mud stream.

Figure 2:
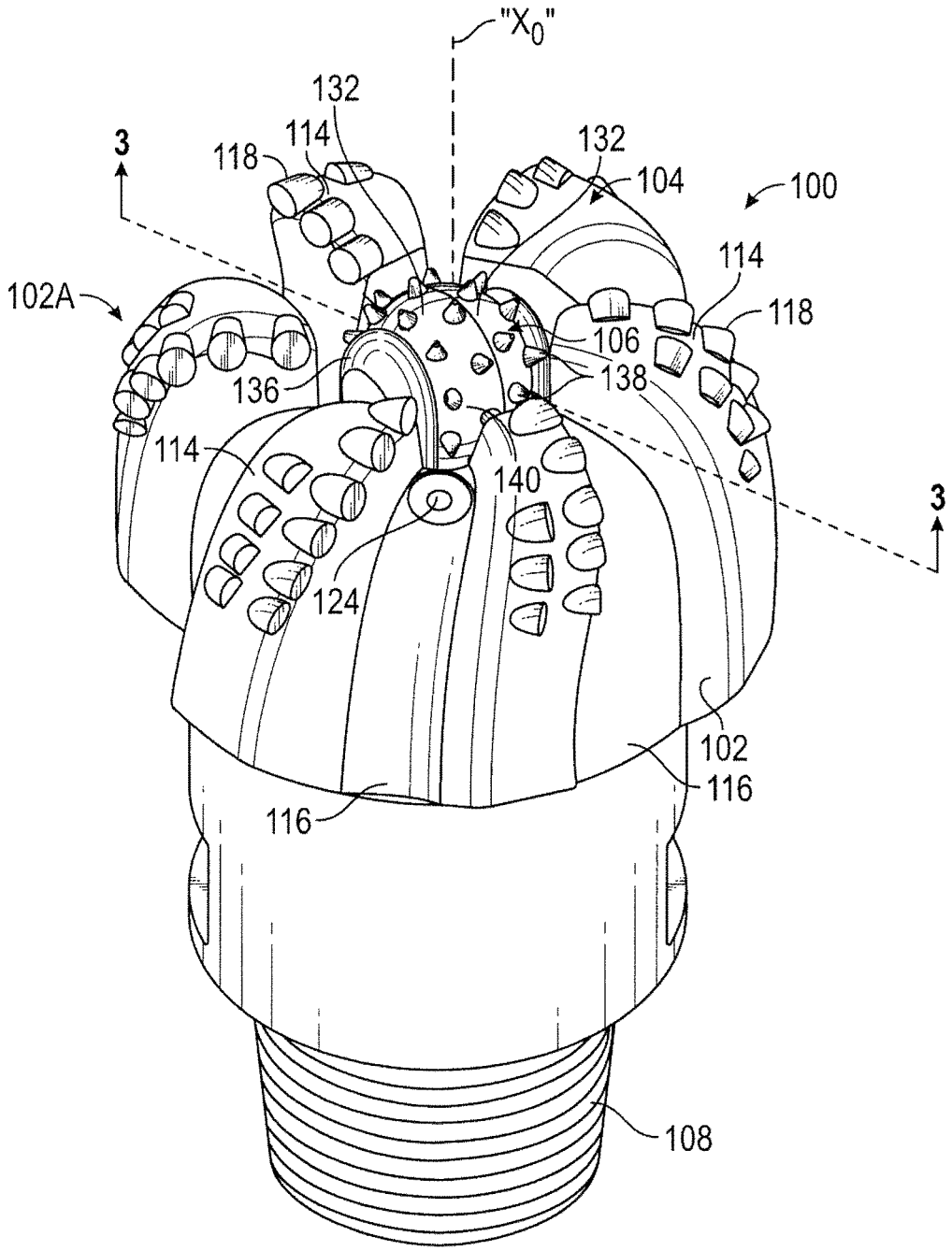
FIG. 2 illustrates a perspective top view of the exemplary drill bit of FIG. 1, including a plurality of fixed cutters and an adjustable inner gauge positioned in a center of the plurality of fixed cutters.

FIG. 2 illustrates a perspective top view of the exemplary drill bit of FIG. 1, including a plurality of fixed cutters 104 and an adjustable inner gauge 106 positioned in a center of the plurality of fixed cutters 104. The drill bit 100 may include a connector 108 configured for connection to a drillstring 18 (FIG. 1). The drill bit 100 may include a bit body 102 having an upper portion 103, a connector end portion 107 opposite the upper portion 103 and coupled to the connector 108, and a central bore 150. The central bore 150 defines a bore surface 151 extending through a center of the bit body 102. The bit body 102 may include the plurality of fixed cutters 104 formed on the upper portion 103.

As illustrated in FIG. 2, the drill bit 100 may also include any of various types of connectors 108 extending from the bit body 102 for coupling the drill bit 100 to the drill string 18 (FIG. 1). In some embodiments, the connector 108 may include a threaded pin with American Petroleum Institute (API) threads defined thereon. The bit body 102 defines a bit body rotational axis "$X_0$" extending between a leading end 102*a* and a trailing end 102*b* thereof. In some embodiments, the bit body 102 may be constructed of matrix material formed by infiltrating a reinforcement material, e.g., tungsten carbide powder with a molten binder material, e.g., copper, tin, manganese nickel and zinc as appreciated by those skilled in the art. Alternatively, the bit body 102 may be constructed of a metallic material such as steel or any of various metal alloys generally associated with manufacturing rotary drill bits.

In accordance with some embodiments, the fixed cutters 104 may be disposed peripherally to the bit body, and may include a plurality of cutting blades 114 circumferentially spaced about the counter-rotational cutter 106 with junk slots 116 defined between the cutting blades 114. In some exemplary aspects, the cutting blades 114 of the fixed cutters 104 are asymmetrically arranged about the bit body rotational axis "$X_0$." The junk slots 116 facilitate the removal of geologic materials and debris from the path of the hybrid drill bit 100, e.g., by providing a flow path for drilling mud 36 (FIG. 1) around the bit body 102. The cutting blades 114 support a plurality of fixed cutting elements 118 thereon axially and radially spaced about the counter-rotational cutter 106. As used herein, the term "fixed" generally means that the fixed cutting elements 118 are mounted for maintaining a position and orientation with respect to the bit body 102 as the hybrid drill bit 100 is rotated about the bit body rotational axis "$X_0$."

In some embodiments, the fixed cutting elements 118 may be securely mounted to the cutting blades 114 by brazing or other manufacturing techniques recognized in the art. The fixed cutting elements 118 engage and remove adjacent portions of the geologic formation "G" (FIG. 1), generally by shearing the geologic materials from the bottom and sides of a wellbore 14 (FIG. 1) as the hybrid drill bit 100 rotates downhole. In some embodiments, the fixed cutting elements 118 may include various types of polycrystalline diamond compact (PDC) cutter components.

Figure 3:
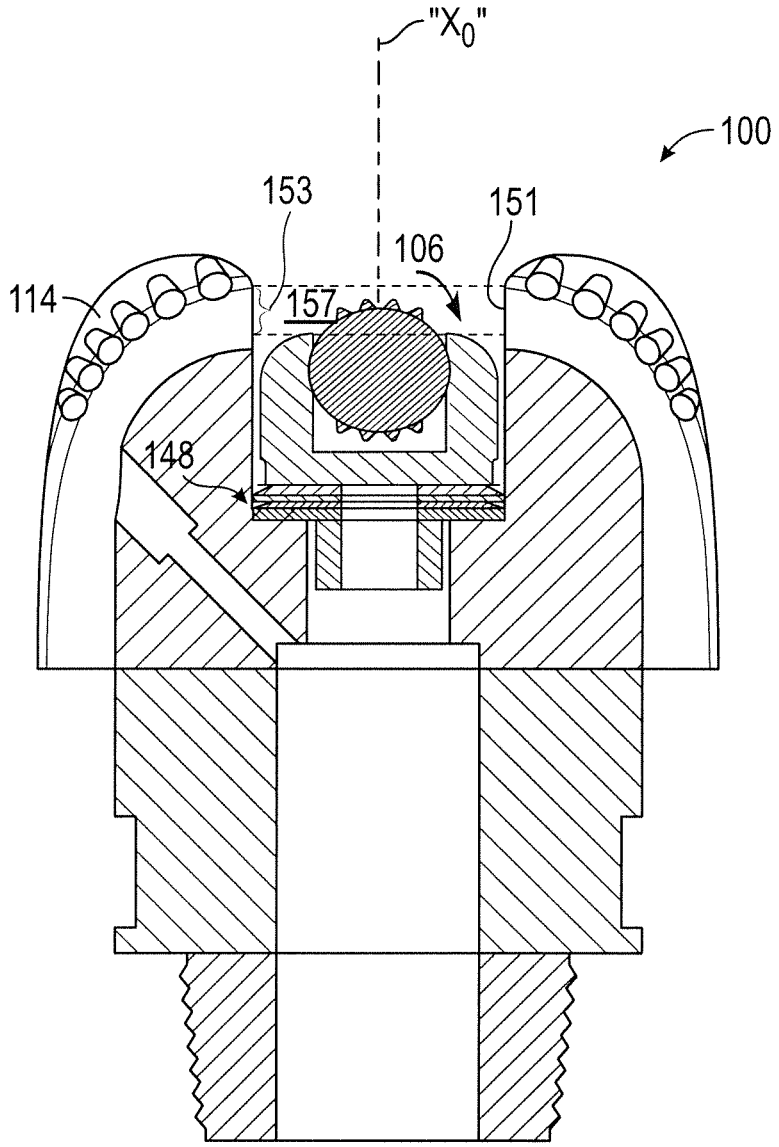
FIG. 3 is a cross-sectional view of the exemplary drill bit of FIG. 2 along line 3-3.

FIG. 3 is cross-sectional view of the exemplary drill bit of FIG. 2 along line 3-3. As illustrated in FIG. 3, the drill bit 100 may further include an adjustable inner gauge 106 movably positioned within the bit body central bore 150. The adjustable inner gauge 106 is moveable within the central bore 150 (in either direction within the central bore 150) to increase or decrease an exposed area 153 of the bore surface for adjusting stability or steerability of the drill bit 100 while forming the wellbore 14 (FIG. 1). The adjustable inner gauge 106 may be constructed of any of the hard materials described above for construction of the fixed cutting elements 118.

In some embodiments, a position of the adjustable inner gauge 106 within the bit body central bore 150 defines the exposed area 153 of the bore surface. That is, as the adjustable inner gauge 106 moves downwards within the central bore 150, the exposed area 153 of the bore surface is increased. Similarly as the adjustable inner gauge 106 moves upwards within the central bore 150, the exposed area 153 of the bore surface is decreased. As illustrated in FIG. 3 the adjustable inner gauge 106 may be moved axially to lengthen or shorten the exposed area 153 of the bore surface. The adjusting of the exposed area 153 yields either an increased amount of stability or an increased amount of steerability based on user needs as described below. That is, during drilling, when the drill bit is engaged with the formation and the level of vibration of the drill bit 100 is larger than desired, the adjustable inner gauge 106 may be moved downwards within the central bore 150, in order to increase the exposed area 153 of the bore surface. An increase in the exposed area 153 provides an increased contact and engagement area for the formation with the drill bit 100, thereby reducing the level of vibration of the drill bit 100, and increasing stability of the drill bit 100 during the drilling. In contrast, when it is desirable that steerability of the drill bit 100 is increased, the adjustable inner gauge 106 is moved upwards within the central bore 150 to decrease the exposed area 153. A decrease in the exposed area 153 provides a decreased contact and engagement area for the formation with the drill bit 100, thereby less inhibiting steerability of the drill bit 100 that may otherwise have been limited by the contact of the drill bit 100 with the formation.

In some embodiments, the increase and decrease of the exposed area 153 may be described in terms of an increase and a decrease of a volume 157 of the bore 150 between an upper surface of the adjustable inner gauge 106 based on an axial position thereof, and an upper end of the bore surface 151. For example, increasing the volume 157 the bore 150 similarly increases stability of the drill bit 100 during the drilling, and decreasing the volume 157 of bore 150 increases steerability of the drill bit 100.

In accordance with some embodiments, the use of an inner gauge element that is reciprocably disposed in the inner bore of the drill bit yields the advantage that the adjustable inner gauge 106 may be axially moved as a single piece within the bore as desired to yield improved steerability or stability. This contrasts with conventional drill bits where the gauge element is mounted on an outer surface of the drill bit body. Thus, the area in which the gauge elements in conventional drill bits may be axially moved is limited due to a dedicated area of the drill bit being necessary for positioning of the junk slots.

Figure 4:
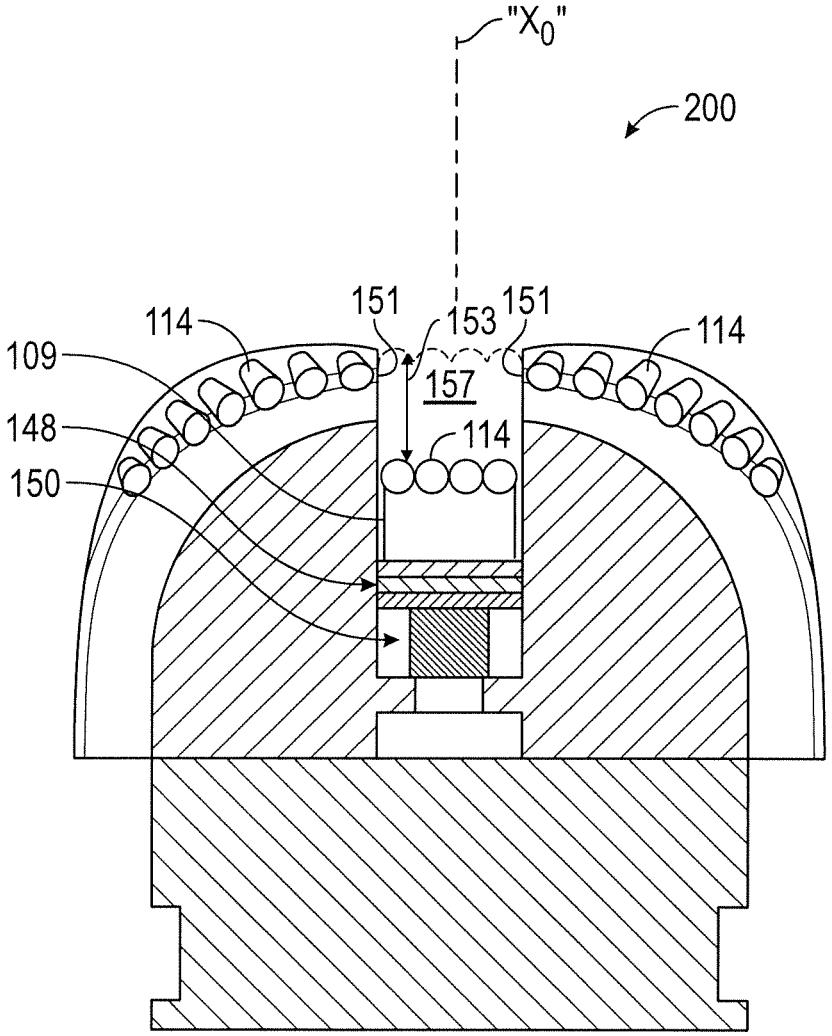
FIG. 4 is a cross-sectional view of another exemplary drill bit.

In some embodiments, as illustrated in FIG. 2, the adjustable inner gauge 106 may be positioned on a rolling cutter 132 reciprocally disposed in the central bore 150 through the connector end portion 107 of the bit body. At least a portion of the rolling cutter 132 may be exposed to the geologic G formation through the bore 150. In other embodiments, as illustrated in FIG. 4, the adjustable inner gauge 109 may be positioned on a polycrystalline diamond cutter 114 reciprocally disposed in the central bore 150 through the connector end portion 107 of the bit body. Similarly, at least a portion of the polycrystalline diamond cutter 114 may be exposed to the geologic G formation through the bore 150.

FIG. 4 is a cross-sectional view of another exemplary drill bit 200. In accordance with some embodiments, similar to the drill bit 100, the drill bit 200 may include an adjustable inner gauge 109 positioned at least in part in the bit body central bore 150 and reciprocably moveable therewithin. The adjustable inner gauge 109 is moveable within the central bore 150 (i.e., in either direction (upwards or downwards) within the central bore 150) to increase or decrease an exposed area 153 of the bore surface for adjusting stability or steerability of the drill bit 100 while forming the wellbore 14 (FIG. 1). Similar to the adjustable inner gauge 106 of FIG. 3, the adjustable inner gauge 109 may be constructed of any of the hard materials described above for construction of the fixed cutting elements 118.

As described above, the adjustable inner gauge 109 may be positioned on a polycrystalline diamond cutter 114 reciprocally disposed in the central bore 150. In some embodiments, the adjustable inner gauge 109 may be positioned on a polycrystalline diamond cutter similar in structure and/or material composition to the cutting blades 114, with the difference being that the polycrystalline diamond cutter 114 is moveable within the central bore 150 (i.e., in either direction (upwards or downwards) within the central bore 150) to increase or decrease an exposed area 153 of the bore surface for adjusting stability or steerability of the drill bit 200. Various aspects of the operation of the adjustable inner gauge 109 can be similar to those described with respect to adjustable inner gauge 106 and therefore, a description thereof shall not be repeated.

Figure 5:
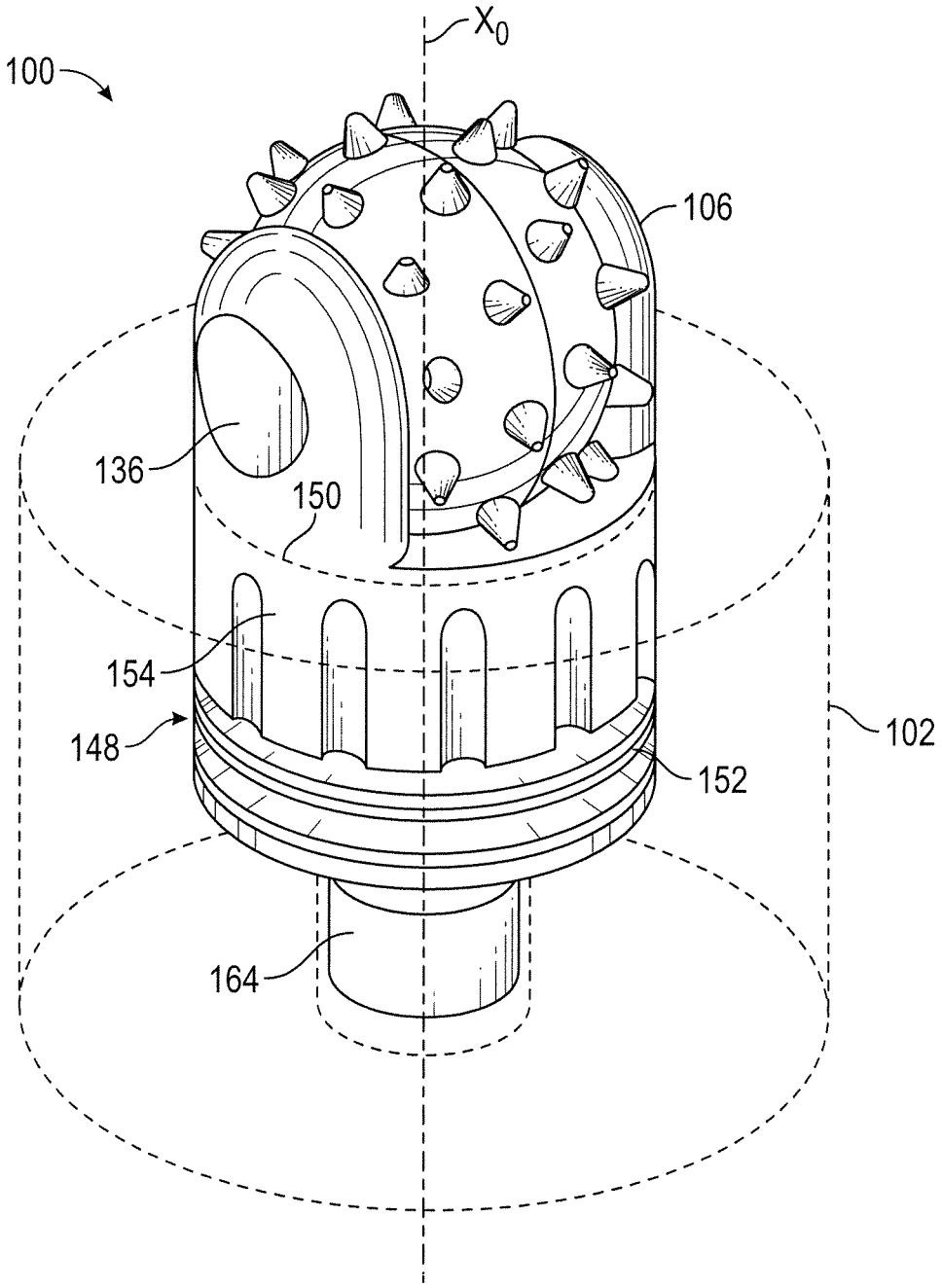
FIG. 5 is perspective view of an exemplary adjustment mechanism of the drill bit of FIG. 2.

FIG. 5 is perspective view of an exemplary adjustment mechanism of the drill bit of FIG. 2. As illustrated in FIG. 5, the drill bit 100 may further comprise an adjustment 148 mechanism coupled to the bit body 102 and the adjustable inner gauge 106 for moving the adjustable inner gauge at a plurality of axial positions within the central bore 150. The adjustment mechanism 148 is operable for dynamically supporting the adjustable inner gauge 106 at a plurality of axial positions within the bore 150 defined in the bit body 102. That is, the adjustment mechanism 148 is operable to axially move the adjustable inner gauge 106 thereby decreasing or increasing the volume 157 of the bore 150 between an upper surface of the adjustable inner gauge 106 based on an axial position thereof, or increasing or decreasing the exposed area of the surface 151. As used herein, a "dynamic" adjustment mechanism includes those structures which permit the axial position of the adjustable inner gauge 106 to be adjusted while the drill bit 100 is operating within the wellbore 14 (FIG. 1). To permit dynamic adjustment, the adjustment mechanism 148 includes a stack of flexible spacer members 152 that can be axially compressed, e.g., by applying an appropriate weight on the drill bit 100. As the stack of spacer members 152 is compressed, the adjustable inner gauge 106 moves axially downwards in the bore 150 of the bit body 102. The weight on the drill bit 100 may be relieved to permit the spacer members 152 to axially expand and move the adjustable inner gauge 106 axially upwards into the bore 150. The exposure or height of the adjustable inner gauge 106 within the bore 150 can thereby be dynamically adjusted.

In some embodiments, the spacer members 152 may include Bellville washers, wave washers or other disc springs recognized in the art. Alternatively or additionally, the spacer members 152 may include one or more compression springs or other structures that may be preloaded such that the amount of weight on bit that must be applied to induce movement of the adjustable inner gauge 106 may be predetermined.

The adjustment mechanism 148 may include a forked axle support 154. The axle supports 154 may hold the axle 136 in a generally orthogonal orientation to the rotational axis "$X_0$." The adjustment mechanism 148 may also include a fastener 164, which secures the forked axle support 154 to the bit body 102.

Figure 6:
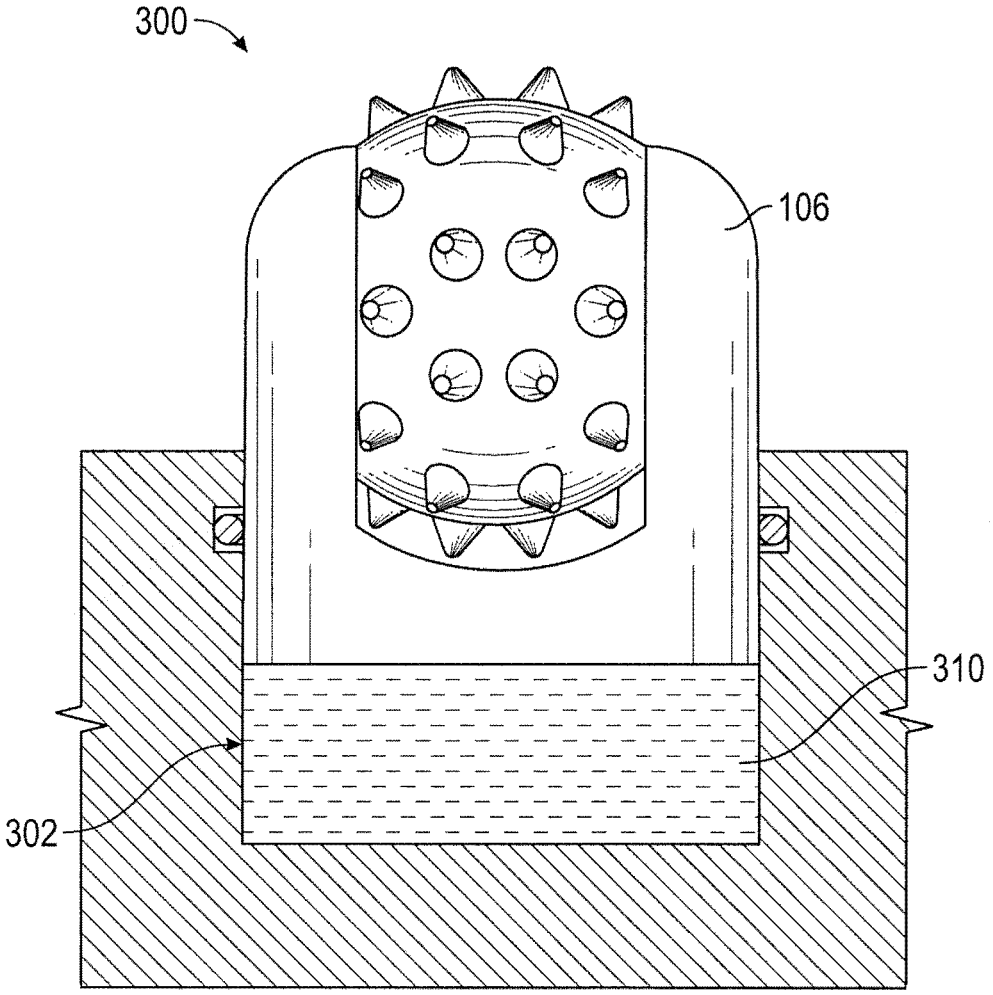
FIG. 6 is another perspective view of an exemplary adjustment mechanism of an exemplary drill bit.

FIG. 6 is another perspective view of an exemplary adjustment mechanism 302 of an exemplary drill bit 300. As illustrated in FIG. 6, the adjustment mechanism 302 may comprise filling the bore 150 at least in part with a support material 310. The support material 310 may include a fluid such as a compressible gas, which may function as a spring between the adjustable inner gauge 106 and the bore surface, or a liquid such as oil, which may provide dampening to the adjustable inner gauge 106. The support material 310 may include a viscoelastic material or a hyper-elastic material such as rubber. The support material 310 may provide shock absorption for the adjustable inner gauge 106 as axial forces are applied to the adjustable inner gauge 106.

In accordance with some embodiments, as illustrated in FIG. 3, a method of drilling a wellbore 14 through a geologic formation "G" may comprise positioning the drill bit 100 coupled to the drillstring 18 in the wellbore 14, and in contact with the formation "G. The method may further include positioning an adjustable inner gauge 106 in the bit body central bore 150, rotating the drill bit 100 to cut the formation G, and adjusting an axial position of the adjustable inner gauge 106 within the central bore 150 to increase or decrease the exposed area 153 of the bore surface. The method may further comprise positioning the adjustable inner gauge 106 on a rolling cutter 132 reciprocally disposed in the central bore through the connector end 107 portion of the bit body 102.

Various examples of aspects of the disclosure are described below as clauses for convenience. These are provided as examples, and do not limit the subject technology.

Clause 1. A drill bit for forming a wellbore through a geologic formation, the drill bit comprising: a connector configured for connection to a drillstring; a bit body having an upper portion, a connector end portion opposite the upper portion and coupled to the connector, a central bore, the central bore defining a bore surface, the bit body including a plurality of fixed cutters formed on the upper portion; and an adjustable inner gauge movably positioned within the bit body central bore to increase or decrease an exposed area of the bore surface for adjusting stability or steerability of the drill bit while forming the wellbore.

Clause 2. The drill bit of Clause 1, wherein the fixed cutters define a portion of the central bore.

Clause 3. The drill bit of Clause 1, wherein each of the fixed cutters includes at least one cutting element.

Clause 4. The drill bit of Clause 1, further comprising an adjustment mechanism coupled to the bit body and the adjustable inner gauge for moving the adjustable inner gauge at a plurality of axial positions within the central bore.

Clause 5. The drill bit of Clause 4, wherein the adjustment mechanism comprises at least one flexible spacer member disposed between the moveable inner gauge and the bit body.

Clause 6. The drill bit of Clause 5, wherein the wherein the flexible spacer member includes a spring.

Clause 7. The drill bit of Clause 6, wherein the spring is under a preload force between the adjustable inner gauge and the bit body to prevent axial movement of the adjustable inner gauge at axial forces below the preload force.

Clause 8. The drill bit of Clause 4, wherein the adjustment mechanism includes a cavity that is filled with a support material selected from the group consisting of compressible gas, liquid, viscoelastic material, and hyper-elastic material.

Clause 9. The drill bit of Clause 1, wherein the adjustable inner gauge comprises a rolling cutter reciprocally disposed in the central bore of the bit body.

Clause 10. The drill bit of Clause 1, wherein the adjustable inner gauge is moveable within the central bore from a first position to a second position to adjust the steerability of the drill bit.

Clause 11. The drill bit of Clause 10, wherein the adjustable inner gauge is moveable within the central bore from a first position to a second position to adjust the stability of the drill bit.

Clause 12. The drill bit of Clause 1, wherein the adjustable inner gauge can be moved in both axial directions within the central bore.

Clause 13. The drill bit of Clause 1, wherein the adjustable inner gauge is positioned on a polycrystalline diamond cutter disposed in the central bore.

Clause 14. The drill bit of Clause 1, wherein the adjustable inner gauge is positioned on a polycrystalline diamond cutter reciprocally disposed in the central bore.

Clause 15. The drill bit of Clause 1, wherein the plurality of fixed cutters are circumferentially spaced about the adjustable inner gauge, the drill bit having junk slots interposed between cutting blades of the fixed cutters.

Clause 16. A method of drilling a wellbore through a geologic formation, the method comprising: positioning a drill bit coupled to a drillstring in the wellbore, and in contact with the formation, the drill bit including a bit body having an upper portion, and a central bore, the central bore defining a bore surface, the bit body including a plurality of fixed cutters formed on the upper portion; positioning an adjustable inner gauge in the bit body central bore; rotating the drill bit to cut the formation; and adjusting an axial position of the adjustable inner gauge within the central bore relative to the plurality of fixed cutters to increase or decrease an exposed area of the bore surface.

Clause 17. The method of Clause 16, further comprising coupling an adjustment mechanism between the bit body and the adjustable inner gauge for moving the adjustable inner gauge to a plurality of axial positions within the central bore.

Clause 18. The method of Clause 16, wherein the exposed area of the bore surface comprises as an upper portion of the bore surface disposed above the adjustable inner gauge.

Clause 19. The method of Clause 16, wherein the adjustable inner gauge comprises a rolling cutter disposed in the central bore.

Clause 20. The method of Clause 16, wherein the adjusting comprises moving the adjustable inner gauge in two directions to increase and decrease an exposed area of the bore surface.

What is claimed is:

1. A drill bit for forming a wellbore through a geologic formation, the drill bit comprising:

a connector configured for connection to a drill string;

a bit body having an upper portion, a connector end portion opposite the upper portion and coupled to the connector, and a central bore, the central bore defining a bore surface, the bit body including a plurality of fixed cutters formed on the upper portion;

an adjustable inner gauge movably positioned within the bit body central bore to increase or decrease an exposed area of the bore surface for adjusting stability or steerability of the drill bit while forming the wellbore;

a rolling cutter coupled to the adjustable inner gauge at an orthogonal orientation with respect to the rotational axis of the bit body and disposed within the central bore; and an adjustment mechanism coupled to the adjustable inner gauge, wherein the adjustment mechanism comprises at least one flexible spacer member disposed between the adjustable inner gauge and the bit body.

2. The drill bit of claim 1, wherein the fixed cutters define a portion of the central bore.

3. The drill bit of claim 1, wherein the adjustment mechanism is configured to move the adjustable inner gauge at a plurality of axial positions within the central bore.

4. The drill bit of claim 3, wherein the adjustment mechanism includes a cavity that is filled with a support material selected from the group consisting of compressible gas, liquid, and viscoelastic material.

5. The drill bit of claim 1, wherein the wherein the flexible spacer member includes a spring.

6. The drill bit of claim 5, wherein the spring is under a preload force between the adjustable inner gauge and the bit body to prevent axial movement of the adjustable inner gauge at axial forces below the preload force.

7. The drill bit of claim 1, wherein the adjustable inner gauge is axially moveable along the central bore from a first position to a second position to decrease the exposed area of the bore surface to increase the steerability of the drill bit.

8. The drill bit of claim 7, wherein the adjustable inner gauge is axially moveable along the central bore from the second position to the first position to increase the exposed area of the bore surface to increase the stability of the drill bit.

9. The drill bit of claim 1, wherein the adjustable inner gauge can be moved in both axial directions within the central bore.

10. The drill bit of claim 1, wherein a polycrystalline diamond cutter is positioned on the adjustable inner gauge disposed in the central bore.

11. The drill bit of claim 1, wherein the plurality of fixed cutters is circumferentially spaced about the adjustable inner gauge, the drill bit having junk slots interposed between cutting blades of the fixed cutters.

12. A method of drilling a wellbore through a geologic formation, the method comprising:

positioning a drill bit coupled to a drill string in the wellbore, and in contact with the formation, the drill bit including a bit body having an upper portion, and a central bore, the central bore defining a bore surface, the bit body including a plurality of fixed cutters formed on the upper portion;

positioning an adjustable inner gauge in the bit body central bore, wherein the adjustable inner gauge comprises a rolling cutter disposed in the central bore;

rotating the drill bit to cut the formation; and adjusting an axial position of the adjustable inner gauge, via an adjustment mechanism, within the central bore relative to the plurality of fixed cutters to increase or decrease an exposed area of the bore surface, wherein the adjustment mechanism comprises a stack of flexible spacer members configured to axially compress.

13. The method of claim 12, wherein the adjustment mechanism is configured to move the adjustable inner gauge to a plurality of axial positions within the central bore.

14. The method of claim 12, wherein the exposed area of the bore surface comprises an upper portion of the bore surface disposed above the adjustable inner gauge.

15. The method of claim 12, wherein the adjusting comprises moving the adjustable inner gauge in two directions to increase and decrease an exposed area of the bore surface.

16. A drill bit for forming a wellbore through a geologic formation, the drill bit comprising:

a connector configured for connection to a drill string;

a bit body having an upper portion, a connector end portion opposite the upper portion and coupled to the connector, and a central bore, the central bore defining a bore surface, the bit body including a plurality of fixed cutters formed on the upper portion;

an adjustable inner gauge movably positioned within the bit body central bore to increase or decrease an exposed area of the bore surface for adjusting stability or steerability of the drill bit while forming the wellbore wherein the adjustable inner gauge comprises a rolling cutter disposed in the central bore; and an adjustment mechanism coupled to the adjustable inner gauge, the adjustment mechanism configured to dampen axial movement of the adjustable inner gauge along the central bore, wherein the adjustment mechanism comprises a cavity at least partially filled with a support material.

17. The drill bit of claim 16, wherein the support material comprises a compressible gas, a viscoelastic material, a hyper-elastic material, or some combination thereof.

18. The drill bit of claim 16, wherein the support material comprises rubber.

19. The drill bit of claim 16, wherein the support material comprises oil.

* * * * *